United States Patent [19]

Kishimoto et al.

[11] Patent Number: 4,546,070

[45] Date of Patent: Oct. 8, 1985

[54] METHOD FOR PROCESSING COLOR PHOTOGRAPHIC LIGHT-SENSITIVE MATERIAL

[75] Inventors: Shinzo Kishimoto; Shigeru Ohno; Akira Abe, all of Kanagawa, Japan

[73] Assignee: Fuji Photo Film Co., Ltd., Kanagawa, Japan

[21] Appl. No.: 680,115

[22] Filed: Dec. 10, 1984

[30] Foreign Application Priority Data

Dec. 12, 1983 [JP] Japan ..... 58-233844

[51] Int. Cl.[4] ..... G03C 7/00

[52] U.S. Cl. ..... 430/393; 430/428; 430/430; 430/461

[58] Field of Search ..... 430/393, 430, 428, 461

[56] References Cited

U.S. PATENT DOCUMENTS

| | | | |
|---|---|---|---|
| 4,033,771 | 7/1977 | Borton et al. | 430/393 |
| 4,163,669 | 8/1979 | Kanada et al. | 430/393 |
| 4,292,401 | 9/1981 | Itoh et al. | 430/461 |
| 4,458,010 | 7/1984 | Yamamuro et al. | 430/430 |

*Primary Examiner*—J. Travis Brown

*Attorney, Agent, or Firm*—Sughrue, Mion, Zinn, Macpeak & Seas

[57] ABSTRACT

A method for processing a color photographic light-sensitive material comprising subjecting an exposed silver halide color photographic light-sensitive material to color development processing then to bleach processing and fixing processing separately, wherein a bath of the bleach processing contains (a) at least one bleach accelerating agent selected from a compound having a mercapto group or a disulfide bond, a thiazolidine derivative and an isothiourea derivative and (b) at least one compound represented by the following general formula (I-a) or (I-b):

(I-a)

(I-b)

wherein M represents a hydrogen atom, an alkali metal atom or an ammonium ion; R represents a hydrogen atom, a substituted or unsubstituted alkyl group, $-SO_3M^1$ or $-COOM^1$; $R^1$ represents $-SO_3M^1$ or $-COOM^1$; $M^1$ represents a hydrogen atom, an alkali metal atom or an ammonium ion; and n represents an integer of 1 to 6 and when n is 2 or more, R's may be the same or different.

According to the method of the present invention, color photographic images having good quality can be obtained without the formation of precipitate in a bleaching bath containing the bleach accelerating agent, even when color photographic light-sensitive materials are continuously processed.

21 Claims, No Drawings

METHOD FOR PROCESSING COLOR PHOTOGRAPHIC LIGHT-SENSITIVE MATERIAL

FIELD OF THE INVENTION

The present invention relates to a method for processing of a silver halide color photographic light-sensitive material (hereinafter referred to as a color light-sensitive material) which comprises developing, bleaching, and fixing an exposed color light-sensitive material (hereinafter referred to as a color photographic processing method), and, more particularly, to an improved bleaching process which accelerates the bleaching function thus shortening the processing time without the occurence of precipitate formed in a bleaching bath containing a bleach accelerating agent when color light-sensitive materials are continuously processed, thus providing color photographic images having good image quality.

BACKGROUND OF THE INVENTION

The fundamental steps of processing color light-sensitive materials generally include a color-developing step and a silver-removing step. That is, an exposed silver halide color photographic light-sensitive material is introduced into a color-developing step, wherein silver halide is reduced with a color-developing agent to produce silver and the oxidized color developing agent in turn reacts with a color former to give a dye image. Subsequently, the color photographic material is introduced into a silver-removing step, wherein silver having been produced in the preceding step is oxidized with an oxidizing agent (usually called a bleaching agent), and dissolved away with a silver ion-complexing agent usually called a fixing agent. Therefore, only a dye image is formed in the thus processed photographic material. In addition to the above-described two fundamental steps of color development and silver removal, actual development processing involves auxiliary steps for maintaining the photographic and physical quality of the resulting image or for improving the preservability of the image. For example, there is a hardening bath for preventing the light-sensitive layer from being excessively softened during photographic processing, a stopping bath for effectively stopping the developing reaction, an image-stabilizing bath for stabilizing the image, and a layer removing bath for removing the backing layer on the support.

In general, ferricyanides, dichromates, ferric chloride, ferric ion complex salts, persulfates, etc. are known as bleaching agents. Of these bleaching agents, ferricyanides, dichromates and ferric chloride are good bleaching agents due to their strong oxidizing ability. However, a bleaching solution containing ferricyanides can release poisonous cyanide by photolysis and dichromates including hexa-valent chromium compounds, both causing environmental pollution. Accordingly, the waste processing solution thereof must be made completely harmless by means of special treatment in view of environmental pollution. Also a bleaching solution containing ferric chloride as a bleaching agent is not desirable because materials constituting vessels in which the solution is retained are liable to be corroded due to the extremely low pH and large oxidizing power of the solution. In addition, iron hydroxide is precipitated in an emulsion layer during the water-washing step provided after the bleaching step, resulting in stain formation.

On the other hand, ferric ion complex salts (e.g., aminopolycarboxylic acid-ferric ion complex salts, particularly iron (III) ethylene-diaminetetraacetate complex salts) are employed together with halides (e.g., bromides) in a bleaching solution.

However, ferric ion complex salts have a comparatively small oxidizing ability and, therefore, have insufficient bleaching power. A bleaching solution containing the complex salt as a bleaching agent can attain some desirable objects when bleaching a low-speed silver halide color photographic light-sensitive material containing, for example, a silver chlorobromide emulsion as a major component. However, such a solution fails to fully remove silver due to insufficient bleaching ability or requires a long time to bleach when processing a high-speed, spectrally sensitized silver halide color photographic light-sensitive material containing a silver chlorobromoiodide emulsion or silver iodobromide emulsion as a major component, particularly color reversal light-sensitive materials for photographing or color negative light-sensitive materials for photographing comprising an emulsion containing larger amounts of silver.

Other known bleaching agents than ferric ion complex salts include persulfates. Persulfates are usually used in a bleaching solution together with a chloride. However, this persulfate-containing bleaching solution has less bleaching ability than ferric ion complex salts, thus requiring a substantially long period of time for bleaching.

As described above, bleaching agents which do not cause environmental pollution or corrode vessels and apparatuses have only a weak bleaching ability. Hence, there has been a need to enhance the bleaching ability of a bleaching solution containing a bleaching agent with a weak bleaching ability, particularly a ferric ion complex salt.

In order to perform sufficient bleaching processing using a bleaching solution containing a ferric ion complex salt which has an insufficient bleaching ability, it has been proposed to add various bleach accelerating agents to the processing bath.

Examples of such bleach accelerating agents for bleaching solutions containing a ferric ion complex salt include various mercapto compounds as described in U.S. Pat. No. 3,893,858, Japanese Patent Application (OPI) Nos. 32736/78, 57831/78, 104232/78, 124424/78, 141623/78 and 52534/79, etc.; compounds having a disulfide bond as described in British Patent No. 1,337,346, Japanese Patent Application (OPI) Nos. 95630/78 and 95631/78, etc.; thiazolidine derivatives as described in Japanese Patent Publication No. 9854/78, Japanese Patent Application No. 88938/83 (corresponding to U.S. Ser. No. 612,173 filed on May 21, 1984), etc.; isothiourea derivatives as described in Japanese Patent Application (OPI) No. 94927/78, etc., thioamide compounds as described in Japanese Patent Application (OPI) No. 42349/74, etc.; dithiocarbamates as described in Japanese Patent Application (OPI) Nos. 26506/80 and 20832/77, etc.; and the like.

Of these bleach accelerating agents, however, thioamide compounds and dithiocarbamates have insufficient bleach accelerating effects and therefore, can not achieve the purpose of accelerating a bleaching step. On the other hand, some of the compounds having a mercapto group or a disulfide bond in their molecules, thiazolidine derivatives and isothiourea derivatives have substantially sufficient bleach accelerating effects. These compounds, however, have a large defect in that precipitate is formed in a bleaching solution when color light-sensitive materials are continuously processed in the bleaching solution containing these bleach accelerating agents. Particularly, the above-described precipitate is likely to occur when color light-sensitive materials for photographing comprising an emulsion containing silver iodobromide as a major component and large amount of silver are continuously processed with a low level replenishment or when a reproduced bleaching solution is used.

SUMMARY OF THE INVENTION

An object of the present invention is to provide a method for processing a color light-sensitive material which has excellent bleaching speed and which can provide color photographic images having good quality without the formation of precipitate in a bleaching solution containing a bleach accelerating agent when color light-sensitive materials are continuously processed.

Another object of the present invention is to provide a color photographic processing method which uses a compound having a low toxic character and which meets the requirement of preventing environmental pollution.

A further object of the present invention is to provide a color photographic processing method involving a bleaching step in which an enhanced bleaching ability is attained without deteriorating other photographic properties and a bleaching solution having good stability is used using a bleaching agent having a weak bleaching ability, in particular a ferric ion complex salt.

Other objects of the present invention will become apparent from the following detailed description and examples.

The above-described objects of the present invention can be attained by a method for processing a color photographic light-sensitive material comprising subjecting an exposed silver halide color photographic light-sensitive material to color development processing then to bleach processing and fixing processing separately, wherein a bath of the bleach processing contains (a) at least one bleach accelerating agent selected from a compound having a mercapto group or a disulfide bond, a thiazolidine derivative and an isothiourea derivative and (b) at least one compound represented by the following general formula (I-a) or (I-b):

(I-a)

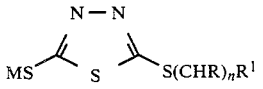

(I-b)

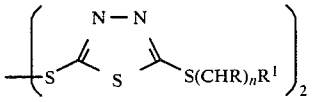

wherein M represents a hydrogen atom, an alkali metal atom or an ammonium ion; R represents a hydrogen atom, a substituted or unsubstituted alkyl group, $-SO_3M^1$ or $-COOM^1$; $R^1$ represents $-SO_3M^1$ or $-COOM^1$; $M^1$ represents a hydrogen atom, an alkali metal atom or an ammonium ion; and n represents an integer of 1 to 6 and when n is 2 or more, R's may be the same or different.

DETAILED DESCRIPTION OF THE INVENTION

The compounds represented by the general formula (I-a) or (I-b) are described in detail below.

In the general formula (I-a) or (I-b), the substituted or unsubstituted alkyl group represented by R is preferably a substituted or unsubstituted alkyl group having from 1 to 6 carbon atoms including, for example, a methyl group, an ethyl group, a propyl group, a carboxymethyl group, etc.

Examples of the alkali metal atom represented by M or $M^1$ include a lithium atom, a sodium atom, a potassium atom, etc.

Examples of the substituent for the alkyl group represented by R include a sulfonic acid group, a carboxylic acid group, a hydroxy group, etc.

General methods for syntheses of these compounds are described in Japanese Patent Application (OPI) Nos. 102639/76, 28426/78, 16734/82 and 26848/82 (corresponding to U.S. Pat. No. 4,371,610) and Japanese Patent Publication No. 35494/73.

Specific examples of the compounds represented by the general formula (I-a) or (I-b) are set forth below, but the present invention should not be construed as being limited thereto.

(I-a)-(1)

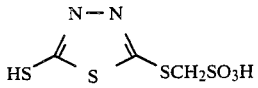

(I-a)-(2)

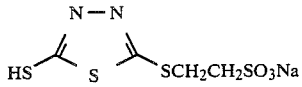

(I-a)-(3)

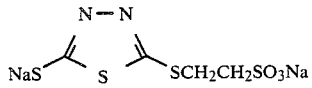

(I-a)-(4)

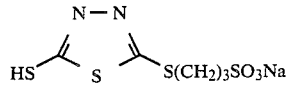

(I-a)-(5)

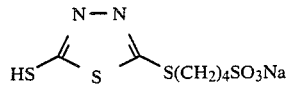

(I-a)-(6)

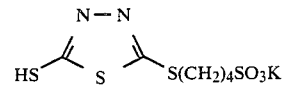

(I-a)-(7)

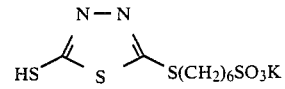

(I-a)-(8)

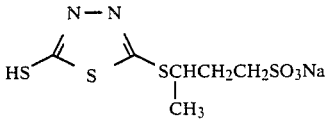

(I-a)-(9)

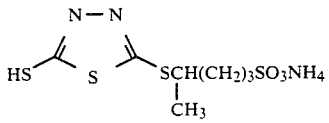

-continued (I-a)-(10)

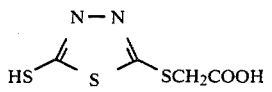

(I-a)-(11)

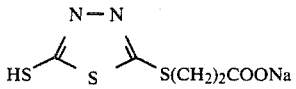

(I-a)-(12)

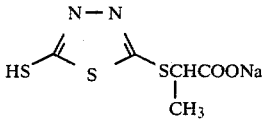

(I-a)-(13)

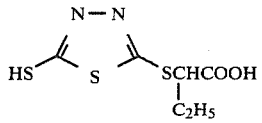

(I-a)-(14)

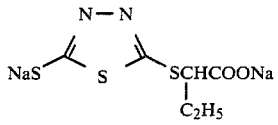

(I-a)-(15)

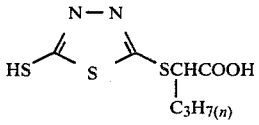

(I-a)-(16)

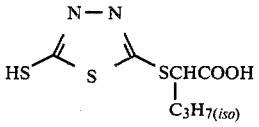

(I-a)-(17)

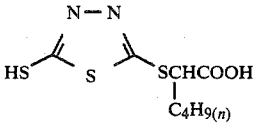

(I-a)-(18)

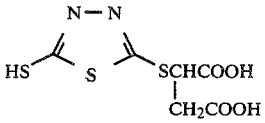

(I-a)-(19)

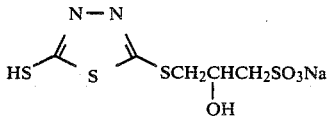

(I-b)-(1)

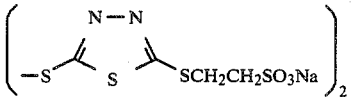

(I-b)-(2)

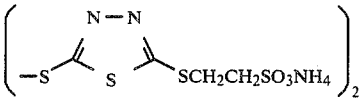

-continued (I-b)-(3)

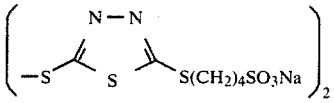

(I-b)-(4)

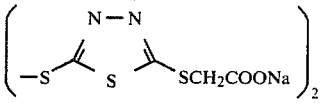

(I-b)-(5)

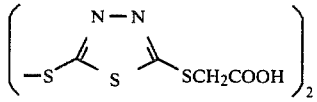

(I-b)-(6)

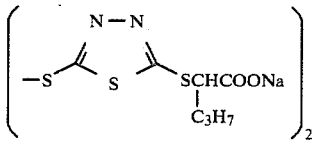

(I-b)-(7)

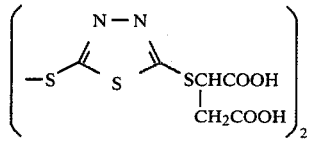

The compounds represented by the general formula (I-a) or (I-b) used in the present invention are known as examples of bleach accelerating agents as described in Japanese Patent Application (OPI) No. 28426/78. However, these compounds only have insufficient bleach accelerating effects and thus can not achieve the purpose of accelerating the bleaching step. On the other hand, the compounds represented by the general formula (I-a) or (I-b) surprisingly function to prevent the occurrence of precipitation which is formed by continuous processing of color light-sensitive materials in a bleaching solution containing the bleach accelerating agents used in the present invention, when they are used together with the bleach accelerating agents which have sufficient bleach accelerating effects.

The amount of the compound represented by the general formula (I-a) or (I-b) according to the present invention to be added to the bleaching solution varies depending upon the kind of processing solution, kind of photographic material to be processed, processing temperature, etc. However, an amount of about $1\times10^{-5}$ to about $1\times10^{-1}$ mol per liter of a processing solution is suitable, with $1\times10^{-4}$ to $5\times10^{-2}$ mol being preferable, and $2\times10^{-4}$ to $1\times10^{-2}$ mol being more preferable.

The compounds having a mercapto group or a disulfide bond, the thiazolidine derivatives and the isothiourea derivatives which are used as bleach accelerating agents in the present invention can be those having sufficient bleach accelerating effects. Preferred examples of these compounds include those represented by the general formula (II) to (VIII) described below and thioglycerol and cysteine.

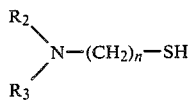

(II)

wherein $R_2$ and $R_3$, which may be the same or different, each represents a hydrogen atom, a substituted or unsubstituted lower alkyl group or an acyl group (preferably having from 1 to 3 carbon atoms, for example, an acetyl group, a propionyl group, etc.) or $R_2$ and $R_3$ may bond to each other to form a ring; and n represents an integer of 1 to 3. It is particularly preferred that $R_2$ and $R_3$ each represents a substituted or unsubstituted lower alkyl group.

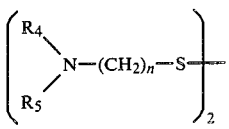

(III)

wherein $R_4$ and $R_5$ each has the same meaning for $R_2$ and $R_3$ as defined in the general formula (II) or $R_4$ and $R_5$ may bond to each other to form a ring; and n represents an integer of 1 to 3. It is particularly preferred that $R_4$ and $R_5$ each represents a substituted or unsubstituted lower alkyl group.

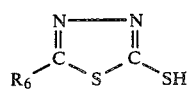

(IV)

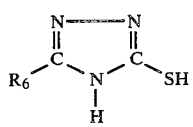

(V)

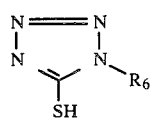

(VI)

wherein $R_6$ represents a hydrogen atom, a halogen atom (for example, a chlorine atom, a bromine atom, etc.), an amino group, a substituted or unsubstituted lower alkyl group (preferably having from 1 to 5 carbon atoms and particularly preferred examples being a methyl group, an ethyl group and a propyl group) or alkyl-substituted amino group (for example, a methylamino group, an ethylamino group, a dimethylamino group, a diethylamino group, etc.).

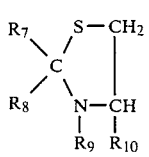

(VII)

wherein $R_7$ and $R_8$, which may be the same or different, each represents a hydrogen atom, an alkyl group which may be substituted (preferably a lower alkyl group, for example, a methyl group, an ethyl group, a propyl group, etc.), a phenyl group which may be substituted or a heterocyclic group which may be substituted (more specifically a group derived from a heterocyclic ring containing at least one hetero atom such as a nitrogen atom, an oxygen atom, a sulfur atom, etc., for example, a pyridine ring, a thiophene ring, a thiazolidine ring, a benzoxazole ring, a benzotriazole ring, a thiazole ring, an imidazole ring, etc.); $R_9$ represents a hydrogen atom or a lower alkyl group which may be substituted (preferably having from 1 to 3 carbon atoms, for example, a methyl group, an ethyl group, etc.; and $R_{10}$ represents a hydrogen atom or a carboxy group. Examples of the substituents included in $R_7$ to $R_9$ are a hydroxy group, a carboxy group, a sulfo group, an amino group, a lower alkyl group, etc.

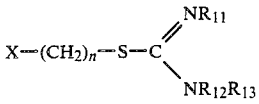

(VIII)

wherein $R_{11}$, $R_{12}$ and $R_{13}$, which may be the same or different, each represents a hydrogen atom or a lower alkyl group (preferably having from 1 to 3 carbon atoms, for example, a methyl group, an ethyl group, etc.) or $R_{11}$ and $R_{12}$ or $R_{11}$ and $R_{13}$ may bond to each other to form a ring; X represents an amino group which may be substituted (examples of the substituents include a lower alkyl group such as a methyl group, etc., an alkoxyalkyl group such as an acetoxymethyl group, etc.), a sulfonic acid group or a carboxy group; and n represents an integer of 1 to 3. It is particularly preferred that $R_{11}$ to $R_{13}$ each represents a hydrogen atom, a methyl group or an ethyl group and X represents an amino group or a dialkylamino group.

In the present invention, the bleach accelerating agents represented by the general formula (II) or (III) are particularly preferred since the bleach accelerating effects are further improved when the agents are used in combination with the compound represented by the general formula (I-a) or (I-b) in comparison with the case wherein the bleach accelerating agents are used alone.

Specific examples of preferred compounds represented by the general formulae (II) to (VIII) are set forth below, but the present invention should not be construed as being limited thereto.

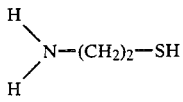

(II)-(1)

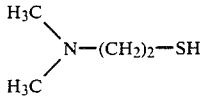

(II)-(2)

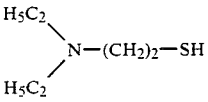

(II)-(3)

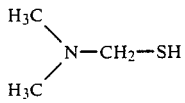

(II)-(4)

-continued
(II)-(5)
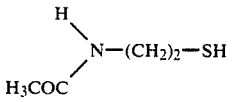
(II)-(6)
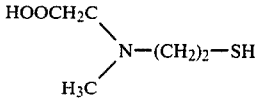
(II)-(7)
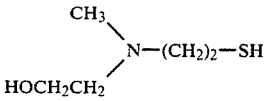
(II)-(8)
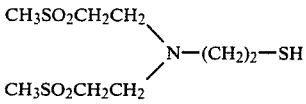
(II)-(9)
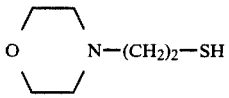
(III)-(1)
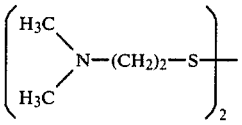
(III)-(2)
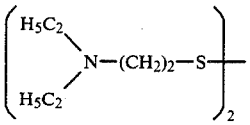
(III)-(3)
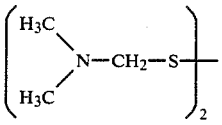
(III)-(4)
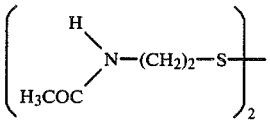
(III)-(5)
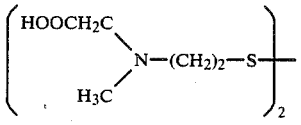
(III)-(6)
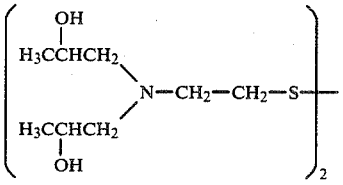
(III)-(7)
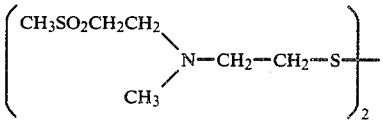
-continued
(III)-(8)
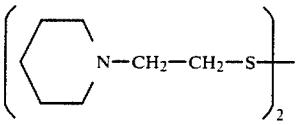
(III)-(9)
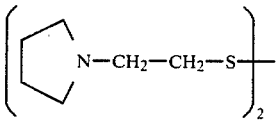
(III)-(10)
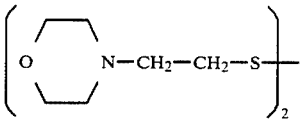
(IV)-(1)
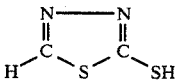
(IV)-(2)
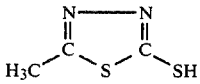
(IV)-(3)
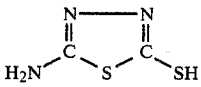
(IV)-(4)
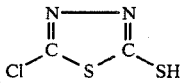
(V)-(1)
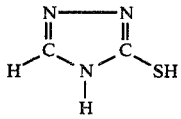
(V)-(2)
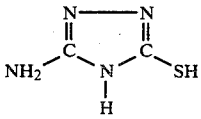
(V)-(3)
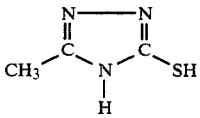
(VI)-(1)
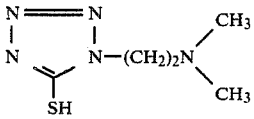
(VI)-(2)
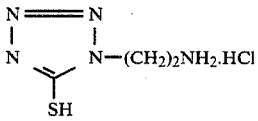

-continued (VII)-(1)

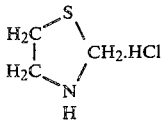

(VII)-(2)

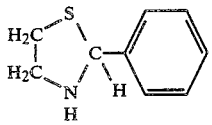

(VII)-(3)

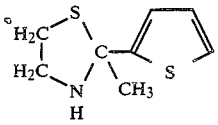

(VII)-(4)

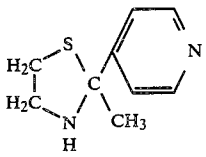

(VII)-(5)

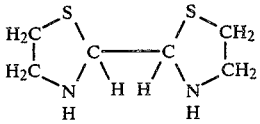

(VII)-(6)

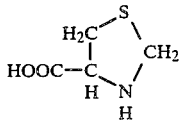

(VIII)-(1)

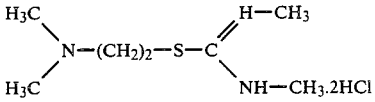

(VIII)-(2)

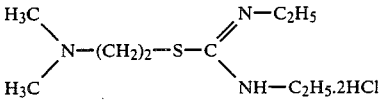

(VIII)-(3)

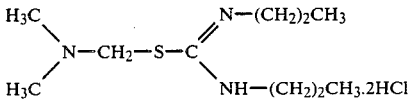

(VIII)-(4)

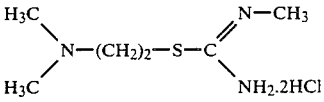

(VIII)-(5)

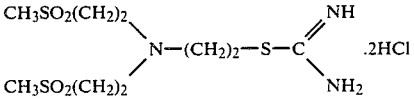

(VIII)-(6)

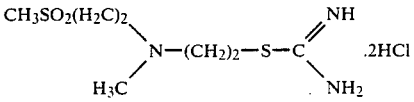

-continued (VIII)-(7)

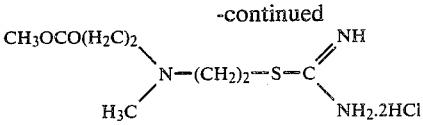

(VIII)-(8)

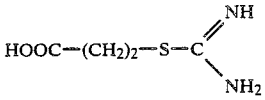

(VIII)-(9)

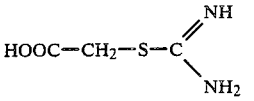

(VIII)-(10)

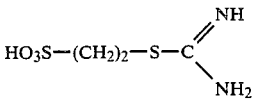

(VIII)-(11)

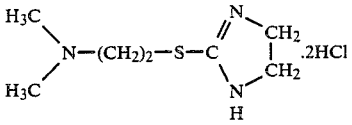

The above-described compounds can be synthesized by known methods. More specifically, the compounds represented by the general formula (II) can be synthesized with reference to the methods as described in U.S. Pat. No. 4,285,984, G. Schwarzenbach et al., *Helv. Chim. Acta.*, Vol. 38, page 1147 (1955), and R. O. Clinton et al., *J. Am. Chem. Soc.*, Vol. 70, page 950 (1948); the compounds represented by the general formula (III) can be synthesized with reference to the methods as described in Japanese Patent Application (OPI) No. 95630/78; the compounds represented by the general formulae (IV) and (V) can be synthesized with reference to the method as described in Japanese Patent Application (OPI) No. 52534/79; the compounds represented by the general formula (VI) can be synthesized with reference to the methods as described in Japanese Patent Application (OPI) Nos. 68568/76, 70763/76 and 50169/78; the compounds represented by the general formula (VII) can be synthesized with reference to the methods as described in Japanese Patent Publication No. 9854/78 and Japanese Patent Application No. 88938/83 (corresponding to U.S. Ser. No. 612,173 filed on May 21, 1984); and the compounds represented by the general formula (VIII) can be synthesized with reference to the methods as described in Japanaese Patent Application (OPI) No. 94927/78.

The amount of the compounds having a mercapto group or a disulfide bond in their molecules, thiazolidine derivatives or isothiourea derivatives according to the present invention to be added to the bleaching solution varies depending upon the kind of processing solution, kind of photographic material to be processed, processing temperature, time necessary for conducting intended processing, etc. However, an amount of about $1\times10^{-5}$ to about $10^{-1}$ mol per liter of a processing solution is suitable, with $1\times10^{-4}$ to $5\times10^{-2}$ mol being preferable.

The compounds (I-a), (I-b) and bleach accelerating agents according to the present invention are generally added to a processing solution by previously dissolving them in water, an alkali, an organic acid, an organic solvent, or the like. If necessary, the compounds (I-a)

and (I-b) and bleach accelerating agents may be directly added to the bleaching solution in the form of powder without adversely affecting their bleach accelerating effects and their effects for preventing the formation of insoluble precipitate.

In the bleaching solution according to the present invention, a bleaching agent with weak bleaching power is used. A ferric ion complex, one of the bleaching agents, is a complex of ferric ion and a chelating agent such as an aminopolycarboxylic acid, an aminopolyphosphonic acid or the salt thereof. Aminopolycarboxylic acid salts or aminopolyphosphonic acid salts are alkali metal salts, ammonium salts or water-soluble amine salts of aminopolycarboxylic acids or aminopolyphosphonic acids. The alkali metals include sodium, potassium, lithium, etc., and water-soluble amines include alkylamines (e.g., methylamine, diethylamine, triethylamine, butylamine, etc.). alicyclic amines (e.g., cyclohexylamine), arylamines (e.g., aniline, m-toluidine, etc.), and heterocyclic amines (e.g., pyridine, morpholine, piperidine, etc.).

Typical examples of the chelating agents of these aminopolycarboxylic acids, aminopolyphosphonic acids, and the salts thereof are:

Ethylenediaminetetraacetic acid;
Disodium ethylenediaminetetraacetate;
Diammonium ethylenediaminetetraacetate;
Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid,
Pentasodium diethylenetriaminepentaacetate;
Ethylenediamine-N-(β-oxyethyl)-N,N',N'-triacetic acid;
Trisodium ethylenediamine-N-(β-oxyethyl)-N,N',N'-triacetate;
Triammonium ethylenediamine-N-(β-oxyethyl)-N,N',N'-triacetate;
Propylenediaminetetraacetic acid;
Disodium propylenediaminetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethylglycine;
Ethyl ether diaminetetraacetic acid;
Glycol ether diaminetetraacetic acid;
Ethylenediaminetetrapropionic acid;
Phenylenediaminetetraacetic acid;
1,3-Diaminopropanol-N,N-N',N'-tetramethylenephosphonic acid;
Ethylenediamine-N,N,N',N'-tetramethylenephosphonic acid;
1,3-Propylenediamine-N,N,N',N'-tetramethylenephosphonic acid; etc.

The present invention is not limited to the above-illustrated chelating agents.

The ferric ion complex salts may be used in the form of the complex salt or may be formed in situ in a solution by using a ferric salt (e.g., ferric sulfate, ferric chloride, ferric nitrate, ferric ammonium sulfate or ferric phosphate, etc.) and a chelating agent (e.g., aminopolycarboxylic acid, aminopolyphosphonic acid or phosphonocarboxylic acid, etc.). When they are used in the form of a complex salt, they may be used alone or in combination of two or more. On the other hand, where a complex is formed in situ in a solution by using a ferric salt and a chelating agent, one, two or more ferric salts may be used. Further, one, two or more chelating agents may also be used. In every case, a chelating agent may be used in an amount more than is necessary for forming a ferric ion complex salt.

A bleaching solution containing the above-described ferric ion complex may further contain complexes of other metals than iron such as cobalt or copper or hydrogen peroxide.

The bleaching solution according to the present invention can contain re-halogenating agents such as bromides (e.g., potassium bromide, sodium bromide, ammonium bromide, etc.), chlorides (e.g., potassium chloride, sodium chloride, ammonium chloride, etc.), and the like in addition to the bleaching agents such as ferric ion complex salts, etc. and the above-described compounds. Further, additives which have a pH-buffering ability such as inorganic acids, organic acids, or the salts thereof which are known to be used in ordinary bleaching solutions (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

The amount of bleaching agent is from about 0.1 to about 2 mols per liter of the bleaching solution, and the pH of the bleaching solution is desirably from about 3.0 to about 8.0, particularly from 4.0 to 7.0, when a ferric ion complex salt is used.

Primary aromatic amine color developing agents to be used in the present invention in a color developing solution include a wide range of known ones for use in various color photographic processes. The developing agents include aminophenol derivativess and p-phenylenediamine derivatives. These compounds are generally used in the form of salts such as hydrochlorides or sulfates rather than in free form in view of stability. They are generally used in an amount of from about 0.1 g to about 30 g, more preferably from about 1 g to about 15 g, per liter of color developing solution.

The aminophenol type developing agents include, for example, o-aminophenol, p-aminophenol, 5-amino-2-hydroxytoluene, 2-amino-3-hydroxytoluene, 2-hydroxy-3-amino-1,4-dimethylbenzene, etc.

Particularly useful primary aromatic amine type color developing agents are N,N-dialkyl-p-phenylenediamine compounds wherein the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline-p-toluenesulfonate, etc.

The alkaline color developing solution to be used in the present invention can optionally contain, in addition to the above-described primary aromatic amine color developing agent, various ingredients usually added to a color developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc.

The pH of the color developing solution is usually about 7 or above, most generally from about 9 to about 13.

The process of the present invention is applicable to color reversal processing. In the present invention, as a black-and-white developing solution to be used in this processing, a black-and-white first developing solution used for reversal processing of color photographic light-sensitive materials or that to be used for processing black-and-white photographic light-sensitive materials can be used. In addition, various well known additives generally added to a black-and-white developing solution can be incorporated in the solution.

Typical additives include developing agents such as 1-phenyl-3-pyrazolidone, metol, and hydroquinone; preservatives such as sulfites; accelerating agents comprising an alkali such as sodium hydroxide, sodium carbonate, or potassium carbonate; inorganic or organic inhibitors such as potassium bromide, 2-methylbenzimidazole, methylbenzothiazole, etc.; water-softening agents such as polyphosphoric acid salts; and slight amounts of development restrainers comprising an iodide or a mercapto compound.

Silver halide color photographic light-sensitive materials to be processed according to the present invention in the presence of the compound according to the present invention are known color photographic light-sensitive materials. The present invention is particularly advantageous for processing coupler-containing multilayer negative color photographic light-sensitive materials or color print photographic light-sensitive materials or for processing color photographic light-sensitive materials designed to be subjected to reversal color processing. In addition, color X-ray photographic light-sensitive materials, monolayer special color photographic light-sensitive materials, and color photographic light-sensitive materials containing a black-and-white developing agents such as a 3-pyrazolidone as described in U.S. Pat. Nos. 2,751,297 and 3,902,905, Japanese Patent Application (OPI) Nos. 64339/81, 85748/81 and 85749/81, and a color developing agent precursor described in U.S. Pat. Nos. 2,478,400, 3,342,597, 3,342,599, 3,719,492 and 4,214,047, Japanese Patent Application (OPI) No. 135628/78 can be processed according to the present invention. Further, the processing may be conducted by allowing a coupler to exist in a developing solution.

In a photographic emulsion layer of color light-sensitive material used in the present invention, any of silver bromide, silver iodobromide, silver iodochlorobromide, silver chlorobromide, and silver chloride may be used as a silver halide.

The photographic emulsion to be used in the present invention can be prepared by the processes as described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

In the present invention, both negative emulsions forming surface latent images and direct reversal emulsions can be used. Examples of the latter emulsions include emulsions forming internal latent images and previously fogged direct reversal emulsions.

Silver halide emulsions may be used as so-called primitive emulsions without conducting chemical sensitization, but are usually chemically sensitized. Chemical sensitization can be conducted according to the processes described in the above-described books by Glafkides or Zelikman et al. or in H. Fireser, *Die Grundlagen der Photographischen Prozesse mit Silberhalogeniden* (Akademische Verlagsgesellschaft, 1968).

That is, sulfur sensitization using sulfur-containing compounds capable of reacting with silver ion or active gelatin, reduction sensitization using a reductive substance, and noble metal sensitization using compounds of noble metals such as gold or etc. can be employed alone or in combination. Examples of useful sulfur sensitizers include thiosulfates, thioureas, thiazoles, rhodanines, and other compounds. Examples of useful reduction sensitizers include stannous salts, amines, hydrazine derivatives, formamidinesulfinic acids and silane compounds. For noble metal sensitization, complexes of the group VIII metals in the Periodic Table such as platinum, iridium, palladium, etc., can be used as well as gold complexes.

Photographic emulsions may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes.

In addition to a silver halide emulsion layer having the above-described light sensitivity, a substantially light-insensitive, fine grain silver halide emulsion layer for the purpose of improving graininess or sharpness or for other purposes can be included. Such substantially light-insensitive, fine grain emulsion layer can be provided on the light-sensitive silver halide emulsion layer or between the light-sensitive silver halide emulsion layer and a colloidal silver layer (yellow filter layer or antihalation layer).

The light-sensitive material according to the present invention may contain a polyalkylene oxide or its ether, ester or amine derivatives, a thioether compound, a thiomorpholine, a quaternary ammonium salt compound, a urethane derivative, a urea derivative, an imidazole derivative, a 3-pyrazolidone, etc., for the purpose of increasing sensitivity or contrast or for accelerating development.

As binders for photographic emulsion layers or other constituent layers gelatin is advantageously employed, but other hydrophilic colloids may also be used.

Various compounds may be incorporated in the light-sensitive material according to the present invention as antifoggants or stabilizers. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); heterocyclic mercapto compounds (e.g., mercaptothiazoles, mercaptobenzothiazoles, mercaptobenzimidazoles, mercaptothiadiazoles, mercaptotetrazoles (e.g., 1-phenyl-5-mercaptotetrazole), and mercaptopyrimidines); heterocyclic mercapto compounds having a water-soluble group such as a carboxy group or a sulfo group; thioketo compounds (e.g., oxazolinthione); azaindenes (e.g., tetraazaindenes (particularly 4-hydroxy-substituted (1,3,3a,7) tetraazaindenes); benzenethiosulfonic acids; benzenesulfinic acids; etc., can be added.

The photographic light-sensitive material according to the present invention may contain an organic or inorganic hardener in its photographic emulsion layers or other constituent layers. For example, chromium slats (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., can be used alone or in combination.

The photographic light-sensitive material according to the present invention may contain in its photographic emulsion layers or other constituent layers various surfactants for various purposes such as improvement of coating properties, antistatic properties, slipping properties, emulsion dispersibility, anti-adhesion properties, and photographic properties (for example, development acceleration, increase in contrast, sensitization, etc.).

The light-sensitive material according to the present invention may contain in its photographic emulsion layers color-forming couplers, that is, compounds capable of forming color by oxidative coupling with an aromatic primary amine developing agent (for example, a phenylenediamine derivative or an aminophenol derivative) in color development processing. For example, magenta couplers include 5-pyrazolone coupler, pyrazolobenzimidazole coupler, cyanoacetylcoumarone coupler, open-chain acylacetonitrile coupler, etc., yellow couplers include acylacetamide couplers (e.g., benzoylacetanilides, pivaloylacetanilides, etc.), and cyan couplers include naphthol couplers, phenol couplers, etc. Of these couplers, non-diffusible couplers having a hydrophobic group called ballast group in their molecular are desirable. The couplers may be of either 4-equivalent type or 2-equivalent type to silver ion. Colored couplers having color-correcting effect or couplers capable of releasing a development inhibitor upon development (so-called DIR couplers) may also be used. In addition to DIR couplers, non-color forming DIR coupling compounds capable of forming a colorless coupling reaction product and releasing a development inhibitor and DIR redox compounds may also be incorporated.

The light-sensitive material according to the present invention can contain a developing agent, including those described in *Research Disclosure,* Vol. 176, page 29 under the item of "Developing agents".

The light-sensitive material prepared according to the present invention may contain a dye in its photographic emulsion layers or other constituent layers as a filter dye or for various purposes such as prevention of irradiation. Examples of such dyes include those described in *Research Disclosure,* Vol. 176, pages 25 to 27 under the item of "Absorbing and filter dyes".

The light-sensitive material according to the present invention can further contain antistatic agents, plasticizers, matting agents, lubricants, ultraviolet ray-absorbing agents, fluorescent brightening agents, air fog-preventing agents, etc. including those described in *Research Disclosure,* Vol. 176, pages 22 to 27 (1978).

Silver halide emulsion layers and/or other constituent layers are coated on a support by a procedure such as described in *Research Disclosure,* Vol. 176, pages 27 and 28, under the item of "Coating procedures".

The present invention is illustrated in greater detail with reference to the following examples, but the present invention is not to be construed as being limited thereto.

Unless otherwise indicated, all ratios, percents, etc., are by weight.

EXAMPLE 1

Commercially available 35 mm size color negative films of 24 exposures, i.e., FUJI COLOR HR100 (trade name) manufactured by Fuji Photo Film Co., Ltd., were imagewise exposed to light and subjected to continuous development processing according to the processing steps described below. In the bleaching step various bleaching solutions containing the compound represented by the general formula (I-a) or (I-b) and the bleach accelerating agent according to the present invention as shown in Table 2 below were employed, respectively.

| Processing Steps | Temperature | Time |
|---|---|---|
| Color development | 38° C. | 3 min. |
| Bleaching | 38° C. | 1 min and 30 sec. |
| Fixing | 38° C. | 3 min |
| Washing with water | 38° C. | 3 min |
| Stabilizing | 38° C. | 1 min |

The above-described development processing was initiated using 500 ml of each of the mother solutions for processing solutions having the compositions described below and subsequently carried out continuously under the replenish procedure wherein each of the replenishers for processing solutions having the compositions described below was replenished to the processing solution at the rate shown in Table 1 below per roll of the above-described color negative film of 24 exposures processed until 80 rolls of the films was processed. A number of rolls processed before the occurrence of precipitate in the bleaching solution was observed with the naked eye was determined.

Further, a commercially available 35 mm size color negative film, i.e., FUJI COLOR HR400 (trade name) manufactured by Fuji Photo Film Co., Ltd., was subjected to uniform exposure to light in an exposure amount of 25 CMS using a tungsten light source and a filter to adjust color temperature to 4,800° K, then development processing according to the processing steps described above but using the mother solution for the bleaching solution, by which the color negative film had not yet continuously been processed, having the composition shown in Table 2 below. The silver amount remaining in each film sample thus processed was measured according to X-ray fluorometric analysis. These results thus-obtained are shown in Table 2 below.

TABLE 1

| Processing Step | Amount of Replenisher per Roll of Color Negative Film of 24 Exposures (FUJI COLOR HR1OO) |
|---|---|
| Color Development | 50 ml |
| Bleaching | 20 ml |
| Fixing | 40 ml |
| Washing with Water | Running Water |

TABLE 1-continued

| Processing Step | Amount of Replenisher per Roll of Color Negative Film of 24 Exposures (FUJI COLOR HR100) |
|---|---|
| Stabilizing | 40 ml |

The composition of each processing solution used in the above-described processing is set forth below.

| | Mother Solution | Replenisher |
|---|---|---|
| Color Developing Solution | | |
| Trisodium nitrilotriacetate | 1.0 g | 1.1 g |
| Sodium sulfite | 4.0 g | 4.4 g |
| Potassium carbonate | 30.0 g | 32.0 g |
| Potassium bromide | 1.4 g | 0.7 g |
| Hydroxylamine sulfate | 2.4 g | 2.6 g |
| 4-(N—Ethyl-N—β-hydroxyethylamino)-2-methylaniline sulfate | 4.5 g | 5.0 g |
| | 4.5 g | 5.0 g |
| Water to make | 1 l | 1 l |
| Bleaching Solution | | |
| Ammonium bromide | 160.0 g | 176 g |
| Aqueous ammonia (28%) | 25.0 ml | 15 ml |
| Iron (III) sodium ethylenediamine-tetraacetate | 130.0 g | 143 g |
| Glacial acetic acid | 14.0 ml | 14.0 ml |
| Compound of the general formula (I-a) or (I-b) according to the present invention (shown in Table 2) | Amount shown in Table 2 | Amount shown in Table 2 |
| Bleach accelerating agent having one of the general formulae (II) to (VIII) according to the present invention (shown in Table 2) | Amount shown in Table 2 | Amount shown in Table 2 |
| Water to make | 1 l | 1 l |
| Fixing Solution | | |
| Sodium tetrapolyphosphate | 2.0 g | 2.2 g |
| Sodium sulfite | 4.0 g | 4.4 g |
| Ammonium thiosulfate aqueous solution (70%) | 175.0 ml | 193.0 ml |
| Sodium bisulfite | 4.6 g | 5.1 g |
| Water to make | 1 l | 1 l |
| Stabilizing Solution | | |
| Formalin | 8.0 ml | 9.0 ml |
| Water to make | 1 l | 1 l |

TABLE 2

| Sample No. | Bleach Accelerating Agent: Compound | Amount in Mother Solution (mol/l) | Amount in Replenisher (mol/l) | Compound of the General Formula (I): Compound | Amount in Mother Solution (mol/l) | Amount in Replenisher (mol/l) | Number of Rolls Processed before occurrence of Precipitate* | Amount of Remaining Silver (μg/cm²) | Remarks |
|---|---|---|---|---|---|---|---|---|---|
| 1 | — | — | — | — | — | — | More than 80** | 16.5 | Blank |
| 2 | (II)-(2) | $5 \times 10^{-3}$ | $6 \times 10^{-3}$ | — | — | — | 9 | 4.6 | Comparison |
| 3 | (III)-(1) | " | " | — | — | — | 15 | 4.3 | " |
| 4 | (IV)-(3) | " | " | — | — | — | 8 | 6.1 | " |
| 5 | (V)-(1) | " | " | — | — | — | 8 | 6.2 | " |
| 6 | (VI)-(1) | " | " | — | — | — | 8 | 5.7 | " |
| 7 | (VII)-(4) | " | " | — | — | — | 9 | 4.3 | " |
| 8 | (VII)-(6) | " | " | — | — | — | 9 | 5.0 | " |
| 9 | (VIII)-(1) | " | " | — | — | — | 10 | 6.6 | " |
| 10 | (VIII)-(7) | " | " | — | — | — | 10 | 5.5 | " |
| 11 | — | — | — | (I-a)-(5) | $1 \times 10^{-3}$ | $2 \times 10^{-3}$ | More than 80** | 16.0 | " |
| 12 | — | — | — | (I-b)-(1) | $1 \times 10^{-3}$ | $2 \times 10^{-3}$ | " | 16.1 | " |
| 13 | (II)-(2) | $5 \times 10^{-3}$ | $6 \times 10^{-3}$ | (I-a)-(5) | " | " | " | 2.3 | Present Invention |
| 14 | (III)-(I) | " | " | (I-a)-(5) | " | " | " | 1.8 | Present Invention |
| 15 | (III)-(1) | " | " | (I-a)-(13) | " | " | " | 1.8 | Present Invention |
| 16 | " | " | " | (I-b)-(1) | " | " | " | 2.0 | Present Invention |
| 17 | " | " | " | (I-b)-(5) | " | " | " | 2.1 | Present Invention |
| 18 | (IV)-(3) | " | " | (I-a)-(5) | " | " | " | 6.2 | Present Invention |
| 19 | (V)-(1) | " | " | (I-a)-(2) | " | " | " | 6.3 | Present Invention |
| 20 | (VI)-(1) | " | " | (I-a)-(8) | " | " | " | 5.7 | Present Invention |
| 21 | (VII)-(4) | " | " | (I-a)-(12) | " | " | " | 4.5 | Present Invention |
| 22 | (VII)-(6) | " | " | (I-a)-(13) | " | " | " | 5.0 | Present Invention |
| 23 | (VIII)-(1) | " | " | (I-a)-(17) | " | " | " | 6.8 | Present Invention |
| 24 | (VIII)-(7) | " | " | (I-b)-(3) | " | " | " | 5.5 | Present Invention |

*The greater the number of rolls processed, the larger the effect on preventing the occurrence of precipitate.
**The precipitate was not observed after processing 80 rolls of the films.

From the results shown in Table 2, it is understood that although the precipitate occurred in the bleaching solutions in which the bleach accelerating agent according to the present invention was used alone after processing about 10 rolls of the color negative films, the bleaching solutions in which the compound represented by the general formula (I-a) or (I-b) was used together with the bleach accelerating agent according to the present invention had the improved silver removing function without the occurrence of precipitate after processing continuously 80 rolls of the color negative films. Particularly, it is advantageous to use the compound represented by one of the general formulae (II)

to (VIII), as the bleach accelerating agent together with the compound represented by the general formula (I-a) or (I-b) as shown in Sample Nos. 13 to 24 since the accelerating function for removing silver is further improved in comparison with the case wherein the bleach accelerating agent is used alone. Further, it is apparent from the results of Comparison Sample Nos. 11 and 12 that the compound represented by the general formula (I-a) or (I-b) per se hardly exhibits the accelerating function for removing silver.

From these results it can be recognized that the use of the bleach accelerating agent together with the compound represented by the general formula (I-a) or (I-b) in the bleaching solution according to the present invention provides excellent properties in that the accelerating function for removing silver is not affected and in that the precipitate is not formed in the bleaching solution even though a large number of color light-sensitive materials are continuously processed.

EXAMPLE 2

Commercially available 35 mm size color reversal films of 36 exposures, i.e., FUJI CHROME 100 (trade name) manufactured by Fuji Photo Film Co., Ltd., were imagewise exposed to light and subjected to continuous development processing according to the processing steps described below. In the bleaching step various bleaching solutions containing the compound represented by the general formula (I-a) or (I-b) and the bleach accelerating agent according to the present invention as shown in Table 4 below were employed, respectively.

| Processing Steps | Temperature | Time |
|---|---|---|
| First developing bath | 38° C. | 6 min. |
| Washing with water | 38° C. | 2 min. |
| Reversal bath | 38° C. | 2 min. |
| Color developing bath | 38° C. | 6 min. |
| Bleaching bath | 38° C. | 3 min. |
| Fixing bath | 38° C. | 4 min |
| Washing with water | 38° C. | 4 min |
| Stabilizing bath | room temperature | 1 min |

The above-described development processing was initiated using 500 ml of each of the mother solution for processing solutions having the compositions described below and subsequently carried out continuously under the replenish procedure wherein each of the replenishers for processing solutions having the compositions described below was replenished to the processing solution at the rate shown in Table 3 below per roll of the above-described color reversal film of 36 exposures processed until 100 rolls of the films were processed. The number of rolls processed before the occurrence of a precipitate in the bleaching solution was observed with the naked eye was determined.

Further, a commercially available 35 mm size color reversal film, i.e., FUJI CHROME 100 (trade name) manufactured by Fuji Photo Film Co., Ltd., was subjected to uniform exposure using a tungsten light source, then development processing according to the processing steps described above but using the mother solution for the bleaching solution, by which the color reversal film had not yet continuously been processed having the composition shown in Table 4 below. The silver amount remaining in each sample thus processed was measured according to X-ray fluorometric analysis.

These results thus-obtained are shown in Table 4 below.

TABLE 3

| Processing Step | Amount of Replenisher per Roll of Color Reversal Film of 36 Exposures (FUJI CHROME 100) |
|---|---|
| First Development | 111 ml |
| Washing with Water | Running Water |
| Reversal | 55 ml |
| Color Development | 111 ml |
| Bleaching | 11 ml |
| Fixing | 55 ml |
| Washing with Water | Running Water |
| Stabilizing | 55 ml |

The composition of each processing solution used in the above-described processing is set forth below.

| | Mother Solution | Replenisher |
|---|---|---|
| First Developing Bath | | |
| Water | 700 ml | 700 ml |
| Sodium tetrapolyphosphate | 2 g | 2.1 g |
| Sodium sulfite | 20 g | 20.2 g |
| Hydroquinone monosulfonate | 30 g | 30.5 g |
| Sodium carbonate (monohydrate) | 30 g | 30.2 g |
| 1-Phenyl-4-methyl-4-hydroxymethyl-3-pyrazolidone | 2 g | 2.0 g |
| Potassium bromide | 2.5 g | — |
| Potassium thiocyanate | 1.2 g | 1.2 g |
| Potassium iodide (0.1% solution) | 2 ml | — |
| Water to make | 1,000 ml | 1,000 ml |
| Reversal Bath | | |
| Water | 700 ml | 700 ml |
| 6 Na Salt of nitrilo-N,N,N—trimethylenephosphonic acid | 3 g | 3.6 g |
| Stannous chloride (dihydrate) | 1 g | 1.2 g |
| p-Aminophenol | 0.1 g | 0.12 g |
| Sodium hydroxide | 8 g | 9.6 g |
| Glacial acetic acid | 15 ml | 18 ml |
| Water to make | 1,000 ml | 1,000 ml |
| Color Developing Bath | | |
| Water | 700 ml | 700 ml |
| Sodium tetrapolyphosphate | 2 g | 2.5 g |
| Sodium sulfite | 7 g | 8.8 g |
| Sodium tertiary phosphate (12 hydrate) | 36 g | 45 g |
| Potassium bromide | 1 g | 1.2 g |
| Potassium iodide (0.1% solution) | 90 ml | 112 ml |
| Sodium hydroxide | 3 g | 3.8 g |
| Citrazinic acid | 1.5 g | 1.9 g |
| N—Ethyl-N—β-methanesulfonamidoethyl-3-methyl-4-aminoaniline sesquisulfate monohydrate | 11 g | 13.8 g |
| Ethylenediamine | 3 g | 3.8 g |
| Water to make | 1,000 ml | 1,000 ml |
| Bleaching Bath | | |
| Water | 800 ml | 500 ml |
| Sodium ethylenediaminetetraacetate (dihydrate) | 2.0 g | 4.0 g |
| Iron (III) ammonium ethylenediaminetetraacetate (dihydrate) | 120.0 g | 240 g |
| Potassium bromide | 100.0 g | 200 g |
| Compound of the general formula (I-a) or (I-b), according to the present invention (shown in Table 4) | Amount shown in Table 4 | Amount shown in Table 4 |
| Bleach accelerating agent according to the present invention (shown in Table 4) | Amount shown in Table 4 | Amount shown in Table 4 |
| Water to make | 1,000 ml | 1,000 ml |
| Fixing Bath | | |
| Water | 800 ml | 800 ml |
| Ammonium thiosulfate | 80.0 g | 82 g |
| Sodium sulfite | 5.0 g | 5.5 g |
| Sodium bisulfite | 5.0 g | 5.5 g |
| Water to make | 1,000 ml | 1,000 ml |
| Stabilizing Bath | | |
| Water | 800 ml | 800 ml |

-continued

| | Mother Solution | Replenisher |
|---|---|---|
| Formalin (37 wt %) | 5.0 ml | 5.0 ml |
| Fuji Driwel | 5.0 ml | 5.0 ml |
| Water to make | 1,000 ml | 1,000 ml |

TABLE 4

| Sample No. | Bleach Accelerating Agent: Compound | Bleach Accelerating Agent: Amount in Mother Solution (mol/l) | Bleach Accelerating Agent: Amount in Replenisher (mol/l) | Compound of the General Formula (I): Compound | Compound of the General Formula (I): Amount in Mother Solution (mol/l) | Compound of the General Formula (I): Amount in Replenisher (mol/l) | Number of Rolls Processed before occurrence of Precipitate | Amount of Remaining Silver ($\mu g/cm^2$) | Remarks |
|---|---|---|---|---|---|---|---|---|---|
| 25 | — | — | — | — | — | — | More than 100* | 5.2 | Blank |
| 26 | (II)-(1) | $5 \times 10^{-3}$ | $6 \times 10^{-3}$ | — | — | — | 15 | 0.8 | Comparison |
| 27 | (II)-(6) | " | " | — | — | — | 20 | 1.0 | |
| 28 | (II)-(9) | " | " | — | — | — | 13 | 1.2 | " |
| 29 | (III)-(1) | " | " | — | — | — | 22 | 0.8 | " |
| 30 | (III)-(7) | " | " | — | — | — | 13 | 1.5 | " |
| 31 | (III)-(8) | " | " | — | — | — | 13 | 1.1 | " |
| 32 | (IV)-(3) | " | " | — | — | — | 12 | 2.5 | " |
| 33 | (IV)-(2) | " | " | — | — | — | 14 | 2.8 | " |
| 34 | (VI)-(1) | " | " | — | — | — | 14 | 1.6 | " |
| 35 | (VII)-(1) | " | " | — | — | — | 12 | 2.0 | " |
| 36 | (VIII)-(8) | " | " | — | — | — | 15 | 1.8 | " |
| 37 | (VIII)-(11) | " | " | — | — | — | 13 | 1.2 | " |
| 38 | Thioglycerol | " | " | — | — | — | 15 | 2.1 | " |
| 39 | (II)-(1) | " | " | (I-a)-(1) | $1 \times 10^{-3}$ | $2 \times 10^{-3}$ | More than 100* | 0.1 | Present Invention |
| 40 | (II)-(6) | " | " | (I-a)-(19) | " | " | " | 0.2 | Present Invention |
| 41 | (II)-(9) | " | " | (I-B)-(3) | " | " | " | 0.2 | Present Invention |
| 42 | (III)-(1) | " | " | (I-a)-(7) | " | " | " | 0.0 | Present Invention |
| 43 | (III)-(7) | " | " | (I-a)-(1) | " | " | " | 0.3 | Present Invention |
| 44 | (III)-(8) | " | " | (I-b)-(6) | " | " | " | 0.3 | Present Invention |
| 45 | (IV)-(3) | " | " | (I-a)-(13) | " | " | " | 2.7 | Present Invention |
| 46 | (V)-(2) | " | " | (I-a)-(3) | " | " | " | 2.8 | Present Invention |
| 47 | (VI)-(1) | " | " | (I-b)-(1) | " | " | " | 1.6 | Present Invention |
| 48 | (VII)-(1) | " | " | (I-b)-(7) | " | " | " | 2.1 | Present Invention |
| 49 | (VIII)-(8) | " | " | (I-a)-(5) | " | " | " | 1.3 | Present Invention |
| 50 | (VIII)-(11) | " | " | (I-b)-(2) | " | " | " | 2.2 | Present Invention |
| 51 | Thioglycerol | " | " | (I-a)-(9) | " | " | " | 2.2 | Present Invention |

*The precipitate was not observed after processing 100 rolls of the films.

From the results shown in Table 4 it is seen that the precipitate is not formed in the bleaching solutions in which the compound represented by the general formula (I-a) or (I-b) was used together with the bleach accelerating agent according to the present invention as shown in Sample Nos. 39 to 51 in the reversal processing system. Further it is particularly advantageous to use the compound represented by the general formula (II) or (III), as the bleach accelerating agent together with the compound represented by the general formula (I-a) or (I-b) as shown in Sample Nos. 39 to 44 since the accelerating function for removing silver is extremely improved in comparison with the case wherein the bleach accelerating agent is used alone.

From these results it can be recognized that the use of the bleach accelerating agent together with the compound represented by the general formula (I-a) or (I-b) in the bleaching solution according to the present invention provides in the reversal processing system excellent properties in that the accelerating function for removing silver is not damaged and in that the precipitate is not formed in the bleaching solution even though a large number of color light-sensitive materials are continuously processed.

While the invention has been described in detail and with reference to specific embodiments thereof, it will be apparent to one skilled in the art that various changes and modifications can be made therein without departing from the spirit and scope thereof.

What is claimed is:

1. A method for processing a color photographic light-sensitive material comprising subjecting an exposed silver halide color photographic light-sensitive material to color development processing then to bleach processing and fixing processing separately, wherein a bath of the bleach processing contains (a) at least one bleach accelerating agent selected from a compound having a mercapto group or a disulfide bond, a thiazolidine derivative and an isothiourea derivative and (b) at least one compound represented by the following general formula (I-a) or (I-b):

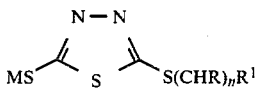
(I-a)

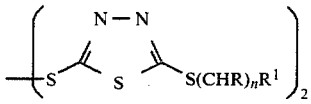
(I-b)

wherein M represents a hydrogen atom, an alkali metal atom or an ammonium ion; R represents a hydrogen atom, a substituted or unsubstituted alkyl group, $-SO_3M^1$ or $-COOM^1$; $R^1$ represents $-SO_3M^1$ or $-COOM^1$; $M^1$ represents a hydrogen atom, an alkali metal atom or an ammonium ion; and n represents an integer of 1 to 6 and when n is 2 or more, R's may be the same or different.

2. A method for processing a color photographic light-sensitive material as claimed in claim 1, wherein the substituted or unsubstituted alkyl group represented by R is a substituted or unsubstituted alkyl group having from 1 to 6 carbon atoms.

3. A method for processing a color photographic light-sensitive material as claimed in claim 1, wherein a substituent for the substituted alkyl group represented by R is a sulfonic acid group, a carboxylic acid group or a hydroxy group.

4. A method for processing a color photographic light-sensitive material as claimed in claim 1, wherein the amount of the compound represented by the general formula (I-a) or (I-b) in the bleaching solution is from about $1\times10^{-5}$ to about $1\times10^{-1}$ mol per liter of the bleaching solution.

5. A method for processing a color photographic light-sensitive material as claimed in claim 1, wherein the bleach accelerating agent is a compound represented by the following general formula (II), (III), (IV), (V), (VI), (VII) or (VIII):

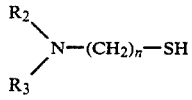
(II)

wherein $R_2$ and $R_3$, which may be the same or different, each represents a hydrogen atom, a substituted or unsubstituted lower alkyl group or an acyl group or $R_2$ and $R_3$ may bond to each other to form a ring; and n represents an integer of 1 to 3:

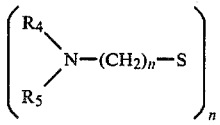
(III)

wherein $R_4$ and $R_5$ each has the same meaning for $R_2$ and $R_3$ as defined in the general formula (II) or $R_4$ and $R_5$ may bond to each other to form a ring; and n represents an integer of 1 to 3:

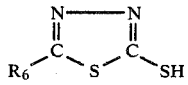
(IV)

-continued

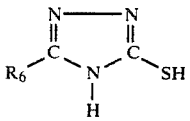
(V)

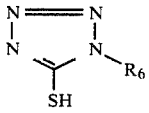
(VI)

wherein $R_6$ represents a hydrogen atom, a halogen atom, an amino group, a substituted or unsubstituted lower alkyl group or an alkyl-substituted amino group,

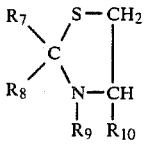
(VII)

wherein $R_7$ and $R_8$, which may be the same or different, each represents a hydrogen atom, an alkyl group which may be substituted, a phenyl group which may be substituted or a heterocyclic group which may be substituted; $R_9$ represents a hydrogen atom or a lower alkyl group which may be substituted; and $R_{10}$ represents a hydrogen atom or a carboxy group, or

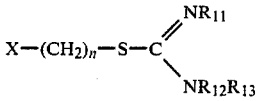
(VIII)

wherein $R_{11}$, $R_{12}$ and $R_{13}$, which may be the same or different, each represents a hydrogen atom or a lower alkyl group or $R_{11}$ and $R_{12}$ or $R_{11}$ and $R_{13}$ may bond to each other to form a ring; X represents an amino group which may be substituted, a sulfonic acid group or a carboxy group; and n represents an integer of 1 to 3.

6. A method for processing a color photographic light-sensitive material as claimed in claim 5, wherein the bleach accelerating agent is a compound represented by the general formula (II) whaerein $R_2$ and $R_3$ each represents a substituted or unsubstituted lower alkyl group.

7. A method for processing a color photographic light-sensitive material as claimed in claim 5, wherein the bleach accelerating agent is a compound represented by the general faormula (III) wherein $R_4$ and $R_5$ each represents a substituted or unsubstituted lower alkyl group.

8. A method for processing a color photographic light-sensitive material as claimed in claim 5, wherein the bleach accelerating agent is a compound represented by the general formula (VIII) wherein $R_{11}$ to $R_{13}$ each represents a hydrogen atom, a methyl group or an ethyl group and X represents an amino group or a dialkylamino group.

9. A method for processing a color photographic light-sensitive material as claimed in claim 5, wherein the bleach accelerating agent is a compound represented by the general formula (II) or (III).

10. A method for processing a color photographic light-sensitive material as claimed in claim 1, wherein the amount of the bleach accelerating agent in the bleaching solution is from about $1\times10^{-5}$ to about $1\times10^{-1}$ mol per liter of the bleaching solution.

11. A method for processing a color photographic light-sensitive material as claimed in claim 1, wherein the bleaching solution further contains a bleaching agent with weak bleaching power.

12. A method for processing a color photographic light-sensitive material as claimed in claim 11, wherein the bleaching agent is a ferric ion complex salt.

13. A method for processing a color photographic light-sensitive material as claimed in claim 12, wherein the ferric ion complex salt is a complex of ferric ion and a chelating agent.

14. A method for processing a color photographic light-sensitive material as claimed in claim 13, wherein the chelating agent is an aminopolycarboxylic acid, an aminopolyphosphonic acid a salt thereof.

15. A method for processing a color photographic light-sensitive material as claimed in claim 11, wherein the amount of the bleaching agent is from about 0.1 to about 2 mol per liter of the bleaching solution.

16. A method for processing a color photographic light-sensitive material as claimed in claim 12, wherein the pH of the bleaching solution is from about 3.0 to about 8.0.

17. A method for processing a color photographic light-sensitive material as claimed in claim 11, wherein the bleaching solution further contains a re-halogenating agent.

18. A method for processing a color photographic light-sensitive material as claimed in claim 1, wherein the color photographic light-sensitive material is a multilayer color photographic light-sensitive material.

19. A method for processing a color photographic light-sensitive mateial as claimed in claim 18, wherein the multilayer color photographic light-sensitive material comprises a support having thereon at least one red-sensitive silver halide emulsion layer containing a cyan color forming coupler, at least one green-sensitive silver halide emulsion layer containing a magenta color forming coupler and at least one blue-sensitive silver halide emulsion layer containing a yellow color forming coupler.

20. A method for processing a color photographic light-sensitive material as claimed in claim 19, wherein the multilayer color photographic light-sensitive material is a color negative light-sensitive material for photographing.

21. A method for processing a color photographic light-sensitive material as claimed in claim 19, wherein the multilayer color photographic light-sensitive material is a color reversal light-sensitive material for photographing.

* * * * *